US007308945B2

(12) United States Patent
Atkins et al.

(10) Patent No.: US 7,308,945 B2
(45) Date of Patent: Dec. 18, 2007

(54) PACKING TOOL AND METHOD

(75) Inventors: Nicholas Atkins, Aberdeen (GB); Craig Spalding, Aberdeen (GB)

(73) Assignee: Rubberatkins Limited, Aberdeen (GB)

( * ) Notice: Subject to any disclaimer, the term of this patent is extended or adjusted under 35 U.S.C. 154(b) by 0 days.

(21) Appl. No.: 10/903,886

(22) Filed: Jul. 29, 2004

(65) Prior Publication Data

US 2005/0028990 A1 Feb. 10, 2005

(30) Foreign Application Priority Data

Jul. 30, 2003 (GB) ..... 0317775.5
Dec. 27, 2003 (GB) ..... 0330068.8

(51) Int. Cl.
*E21B 23/01* (2006.01)

(52) U.S. Cl. ..... 166/387; 166/196; 166/191; 166/134

(58) Field of Classification Search ..... 166/196, 166/179, 387, 191, 134; 277/339, 340, 342
See application file for complete search history.

(56) References Cited

U.S. PATENT DOCUMENTS 3,227,463 A * 1/1966 Wiese ..... 166/187
3,422,673 A * 1/1969 Lebourg ..... 166/187
3,701,382 A * 10/1972 Williams ..... 166/196
5,343,946 A * 9/1994 Morrill ..... 166/196
5,813,460 A * 9/1998 Ringgenberg et al. ..... 166/191

OTHER PUBLICATIONS

European Search Report.

* cited by examiner

*Primary Examiner*—Lanna Mai
*Assistant Examiner*—Matthew J. Smith
(74) *Attorney, Agent, or Firm*—Stephen M. Nipper; Derek H. Maughan; Dykas, Shaver & Nipper, LLP

(57) ABSTRACT

A packing tool comprises a sealing element for mounting on a mandrel so as to define a volume between the sealing element and the mandrel; and a ring member for mounting on the mandrel adjacent the sealing element. The ring member is axially movable relative to the sealing element to cause deformation of the sealing element and includes a communicating bore extending between the volume defined between the sealing element and the mandrel and an exterior portion of the tool.

37 Claims, 4 Drawing Sheets

PACKING TOOL AND METHOD

FIELD OF THE INVENTION

The present invention relates to a packing tool, and in particular to a packing tool for use in the oil and gas exploration and production industries.

BACKGROUND OF THE INVENTION

Packing tools are used to selectively isolate sections of wellbores; typically the packing tools are mounted on a mandrel lowered on production tubing or the like into a bore. The packing tool includes a resilient element which normally allows fluid to flow between the tool and the lining of the bore. Actuation of the tool deforms and expands the resilient element such that it contacts the bore lining; this prevents fluid flow beyond the packing tool location effectively isolating a section of the wellbore.

Packing tools are conventionally of two types, distinguished by the method of actuation of the tool. Inflatable packers are, as the name suggests, actuated by allowing fluid pressure to increase behind a section of the packing element thereby inflating the packer into contact with the liner. Production or test packers compress the resilient packing element between two plates or the like, causing the packing element to bow outwardly into contact with the bore lining.

A disadvantage of conventional production packing tools is that a high axial force is generally needed to provide the necessary deformation and expansion of the packing element, and to maintain it in the expanded position. Inflatable packing tools, on the other hand, rely on maintaining sufficient fluid pressure to maintain the seal; in the event of a pressure drop, the seal may fail.

U.S. Pat. No. 5,467,822 (Zwart) describes a packing tool which combines aspects of inflatable and production packing tools, by providing a resilient packing element between two compression rings, with the packing element including a fluid communication channel extending from an outer surface to an inner cavity. The packing element is expanded by compression from the compression rings, while well fluid enters the communication channel and provides an additional expansion force to the packing element. However, for this tool to function, it is necessary for well fluid to pass between the element and the wellbore liner over at least a portion of the packing element to reach the fluid communication channel. This arrangement leads to an increased risk that well fluid may penetrate the seal between the packing element and the bore liner, leading to a failure of the seal.

It is among the objects of embodiments of the present invention to obviate or alleviate these and other disadvantages of conventional packing tools.

SUMMARY OF THE INVENTION

According to a first aspect of the present invention, there is provided a packing tool comprising:

a sealing element for mounting on a mandrel so as to define a volume between the sealing element and the mandrel; and a ring member for mounting on the mandrel adjacent the sealing element, the ring member being axially movable relative to the sealing element to cause deformation of the sealing element;

wherein the ring member includes a communicating bore extending between the volume defined between the sealing element and the mandrel and an exterior portion of the tool.

Thus, the present invention allows the sealing element to be expanded initially by movement of the ring member into engagement with the sealing element; this causes the sealing element to deform and expand radially outwards to engage with a surrounding bore lining. This diverts fluid flow in the annulus between the packing tool and the bore lining through the communicating bore of the ring member into the volume between the sealing element and the mandrel. A fluid pressure is thereby built up which causes the sealing element to expand further and create a stronger seal. The packing tool of the present invention thus allows a seal to be created using both mechanical and hydraulic expansion of the sealing element, leading to a stronger seal than would be available from either alone. Further, the arrangement of the present invention is such that once the initial mechanical seal is made, it is not necessary for fluid to pass between the bore lining and the sealing element to provide the hydraulic seal; there is hence a reduced likelihood of seal failure.

The volume may be open at an end thereof adjacent the ring member; preferably however the ring member serves to close the volume. Where the ring member closes the volume, the volume will nonetheless still be effectively open to fluid flow by means of the communicating bore; this will not however affect fluid pressure within the volume since fluid will also flow past the packing tool between the sealing element and the wellbore.

Preferably the ring member is movable against a radially inner portion of the sealing member, so as to apply pressure against the sealing member in a radially outer direction. Thus, the mechanical seal is achieved, at least in part, by a radially outward force on the sealing member, rather than a solely axial compression force leading to outward bowing or deformation of the sealing member as with conventional packing tools. This arrangement places less stress on the sealing member, and may result in a longer working life span of the tool.

Preferably the packing tool further comprises an annular element for mounting on the mandrel, on which element the sealing element is mounted. Preferably the annular element is rigid; conveniently the annular element is formed of metal. The annular element may further comprise sealing means for providing a seal between the element and the mandrel; this ensures that fluid will not leak between the mandrel and the annular element, so compromising the hydraulic expansion of the sealing element. Conveniently the sealing means comprises an O-ring or the like.

The annular element may comprise an upper annular element and a lower annular element. In such an arrangement the upper annular element and the lower annular element may be provided with separate sealing means for providing a seal between the element and mandrel. Conveniently the sealing means may be an upper O-ring seal or the like associated with the upper annular element and a lower O-ring seal or the like associated with the lower annular element.

Preferably the annular element comprises an axially extending portion located radially outward of a portion of the sealing element. This serves as a rigid backing portion for the sealing element to prevent bowing or other unwanted distortion when under pressure.

Preferably, the axially extending portion includes a radially inwardly extending lip, the\each lip extending from at least one marginal region of the axially extending portion.

Preferably the sealing element is resilient; more preferably the sealing element is elastomeric. Conveniently the sealing element is resistant to conditions of heat, corrosion, and the like likely to be found downhole. The skilled person will be aware of suitable formulations which may be used.

Preferably the resilient sealing element comprises a relatively hard portion. This hard portion is preferably located towards the other end of the sealing element from the ring member. The presence of a relatively hard portion acts as an anti-extrusion device to prevent flow of softer material which may otherwise occur when the sealing element is under pressure, which would compromise the seal.

The sealing element may in addition, or instead, comprise an annular spring member embedded within the sealing element. The spring may be a garter spring or the like. The spring may comprise a relatively hard core within the spring; this also serves as an anti-extrusion device. In certain embodiments, the spring may be a dual spring; that is, a spring embedded within an outer spring. The spring itself has the additional function of improving resilience of the sealing element and assisting its return to the non-expanded state.

The sealing element may further comprise a second spring member embedded within the sealing element at the portion adjacent the ring member; this also serves to improve resilience of the sealing element. The second spring member may be a band spring or similar construction.

Preferably the sealing element is of tapered form. Preferably the element is axially tapered; preferably toward the end of the element adjacent the ring member. Preferably the radially outer surface of the sealing element is generally flat, while the radially inner surface is generally tapered away from the mandrel. The flat outer surface allows for a greater area of contact between the sealing element and the bore wall, while the tapered inner surface provides for smoother movement of the movable ring member against the sealing element to apply pressure in a radially outward direction.

Preferably the ring member carries a tapered leading face for engaging with the sealing member; as with the tapered surface of the sealing member, this allows for improved movement and contact between the ring member and the sealing member.

The sealing element may be bonded or otherwise fixed to the ring member, or alternatively the sealing element may simply abut the ring member, which may permit a degree of sliding therebetween.

The ring member may be movable by any convenient mechanism; for example, hydraulic or mechanical arrangements. It is common in the field of downhole tools to provide for movement of portions of the tools by means of hydraulic actuation; the person of skill in the art will be familiar with ways in which this may be achieved.

Preferably the communicating bore extends between an outer portion and an inner portion of the ring member; the outer portion will in use be in communication with the annulus between the tool and the bore lining, while the inner portion will be in communication with the volume formed between the sealing element and the mandrel.

The communicating bore may extend between a radially outer portion and a radially inner portion of the ring member. Alternatively, the communicating bore extends axially between an outer portion and an inner portion of the ring member.

The communicating bore may further include a sand-screen.

Preferably the packing tool further comprises a stop for restricting axial movement of the ring member towards the sealing element; this serves to prevent damage to the sealing element by excessive movement. The stop may be mounted on the mandrel, or on the annular element, where this is present.

Preferably the packing tool comprises two sealing elements and ring members arranged generally symmetrically along the mandrel. This arrangement allows the packing tool to be actuated using either downhole or uphole fluid flow.

According to a second aspect of the present invention, there is provided a packing tool comprising:

a mandrel;

a sealing element mounted on the mandrel, and defining a volume between the sealing element and the mandrel; and a ring member mounted on the mandrel adjacent the sealing element, the ring member being axially movable relative to the sealing element to cause deformation of the sealing element;

wherein the ring member includes a communicating bore extending between the volume defined between the sealing element and the mandrel and an exterior portion of the tool.

According to a further aspect of the present invention, there is provided a method of sealing a bore, the method comprising the steps of:

locating in a bore a packing tool comprising a mandrel, and a sealing element and a ring member mounted on the mandrel;

moving the ring member relative to the sealing element to deform the sealing element to contact the bore wall, creating an initial seal; and allowing fluid to flow through a communicating bore in the ring member into a volume between the sealing element and the mandrel to increase pressure in the volume, to further deform the sealing element and maintain the seal.

BRIEF DESCRIPTION OF THE DRAWINGS

These and other aspects of the present invention will now be described by way of example only and with reference to the accompanying drawings, in which.

DETAILED DESCRIPTION OF THE DRAWINGS

Figure 1:
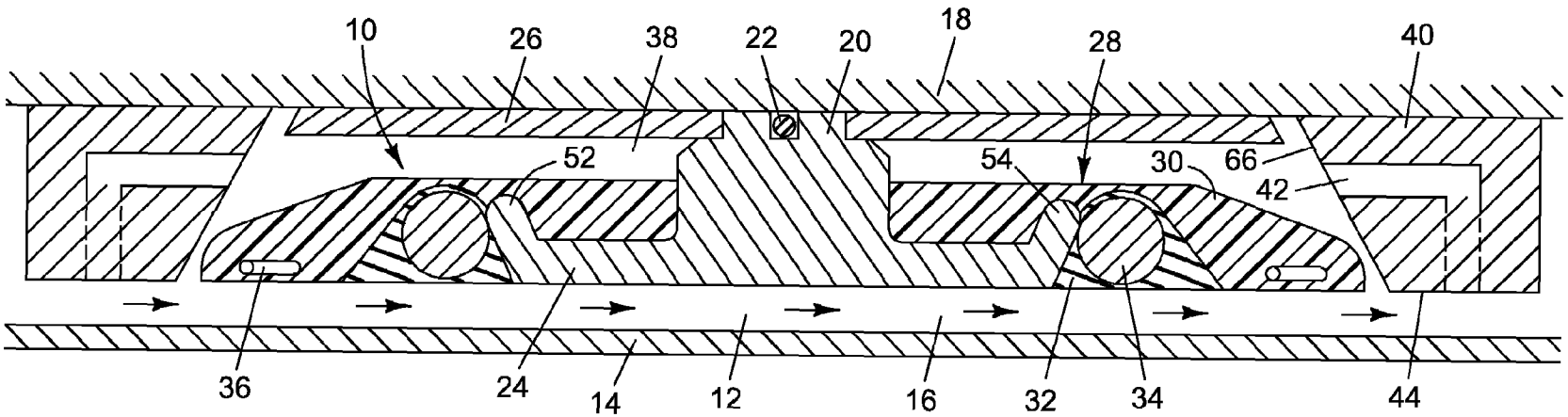
FIG. 1 shows a cross-sectional view of a packing tool in accordance with an embodiment of the present invention in a non-actuated state.

Referring first of all to FIG. 1, this shows a cross-sectional view of a packing tool in accordance with an embodiment of the present invention.

The tool 10 is located within a well bore 12, which is lined with a casing 14. Fluid may flow through the annulus 16 between the tool 10 and the casing 14; the direction of flow is indicated by arrows, although in other applications the well may initially be dormant, that is there is no flow in the annulus 16. The tool 10 is mounted on a mandrel 18.

The tool itself comprises a gauge ring 20 mounted on the mandrel 18, with a sealing O-ring 22 to seal the interface between the gauge ring 20 and the mandrel 18. The gauge ring 20 includes an axially extending portion 24 radially spaced from the mandrel 18. The axially extending portion 24 includes a first radially inwardly extending lip 52 and a second radially inwardly extending lip 54 mounted on the margins of the axially extending portion 24. Mounted on the gauge ring is a cylindrical can serving as a stop 26, which extends axially along the mandrel.

Mounted to the gauge ring 20 is a resilient sealing element 28, which includes a softer elastomeric portion 30, and a harder anti-extrusion rubber portion 32 which includes an embedded double helix garter spring 34. The anti-extrusion portion 32 is located at the axial tip of the axially extending portion 24 of the gauge ring 20.

The softer elastomeric portion 30 of the sealing element 28 is located radially inwardly of, and extends along, the axially extending portion 24 of the gauge ring. The end of the elastomeric portion 30 located away from the gauge ring 20 is tapered away from the mandrel, and includes an embedded band spring 36.

The sealing element 28 is spaced from the mandrel 18 by the gauge ring 20, and defines a volume 38 between the sealing element and the mandrel.

Mounted to the mandrel 18 axially spaced from the sealing element is an axially movable ring member 40, which includes a communicating bore 42 extending from the radially outer surface 44 of the ring member to a radially inner portion of the surface 46 of the ring member adjacent the sealing element 28. The communicating bore 42 thus provides a fluid passage between the annulus 16 and the volume 38 between the sealing element and the mandrel. The lower surface 46 of the ring member 40 is tapered away from the mandrel.

In use, the tool 10 is first of all lowered into a wellbore in the configuration shown in FIG. 1. The tool 10 is in the retracted condition, with the annulus 16 being clear. Fluid may enter the communicating bore 42 from the main bore 12, and thence the volume 38 between the sealing member 28 and mandrel 18, but any increase in pressure is relieved by fluid flowing back through the communicating bore 42 to the annulus 16.

When it is desired to close the annulus 16, the ring members 40 are actuated by a conventional hydraulic control mechanism (not shown) and moved axially toward the sealing element 28. In alternative embodiments of the invention, the ring members 40 may be actuated by a mechanical or an electrical mechanism, rather than a hydraulic mechanism. The tapered surfaces of both the ring members 40 and the sealing element 28 interact to allow the ring member 40 to slip past the tip of the sealing element and to push it radially outward, applying a force in this direction. Excessive movement of the ring member 40 is prevented by the stop 26; when the ring member 40 engages the stop 26, the sealing element has been distorted sufficiently to contact the bore casing 14, and to interrupt any flow through the annulus 16.

Figure 2:
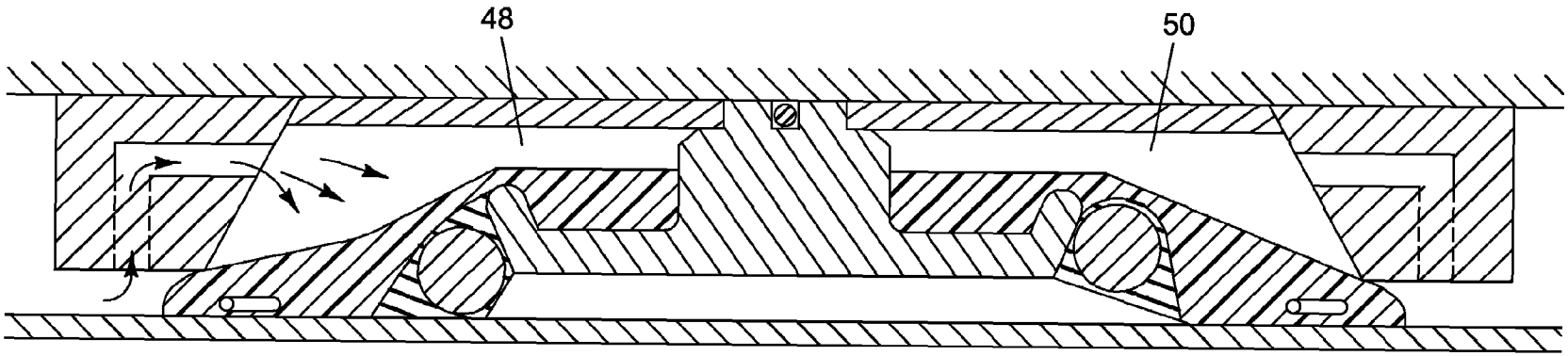
FIG. 2 shows the packing tool of FIG. 1 in an actuated state.

Any subsequent fluid flow in the annulus, whether existing flow or caused by stimulation of the well, is thus diverted along the path indicated by arrows in FIG. 2, along the communicating bore 42 in the ring member 40 and into the volume 38 between the sealing member 28 and mandrel 18. Since the flow path through the annulus 16 is now blocked by the sealing element 28, this diversion causes fluid pressure within the volume 38 to increase. The sealing member 28 is deformed further by this increase in pressure, and is caused to contact the bore casing 14 over a larger surface area than would occur with only the mechanical force exerted by the ring member 40. The anti-extrusion rubber 32 and garter spring 34 within the sealing element 28 extend between the bore casing 14 and the axially extending portions 24 of the gauge ring 20, thereby preventing the softer material of the elastomeric portion 30 of the sealing element from flowing under the high pressure. The axially extending portions 24 of the gauge ring 20 also serve as backing elements to the lower portions of the sealing element 28, preventing these from deforming and bowing under pressure.

The tool is thus in the engaged position shown in FIG. 2. Comparing the upper and lower sections of the tool shown in the Figure, the different extent of contact between the bore casing 14 and the sealing member 28 when fluid pressure is used (upper section 48) and when mechanical pressure only is used (lower section 50) can be seen.

Further, there is relatively little risk of the seal failing in the engaged position, since fluid does not need to flow between the bore casing 14 and the sealing element 28 at any point in this position.

To disengage the tool, the ring members 40 are moved axially away from the sealing element 28; once the mechanical pressure on the sealing element 28 is released, the resilience of the sealing element 28, in combination with the band spring 36 in the tip of the element 28, brings the element back to the disengaged position shown in FIG. 1.

Figure 4:
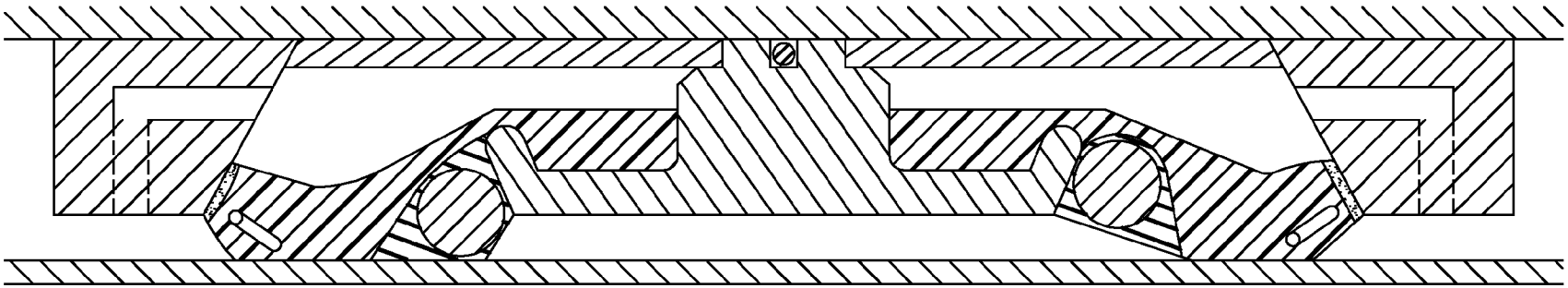
FIG. 4 shows the packing tool of FIG. 3 in an actuated state.
Figure 3:
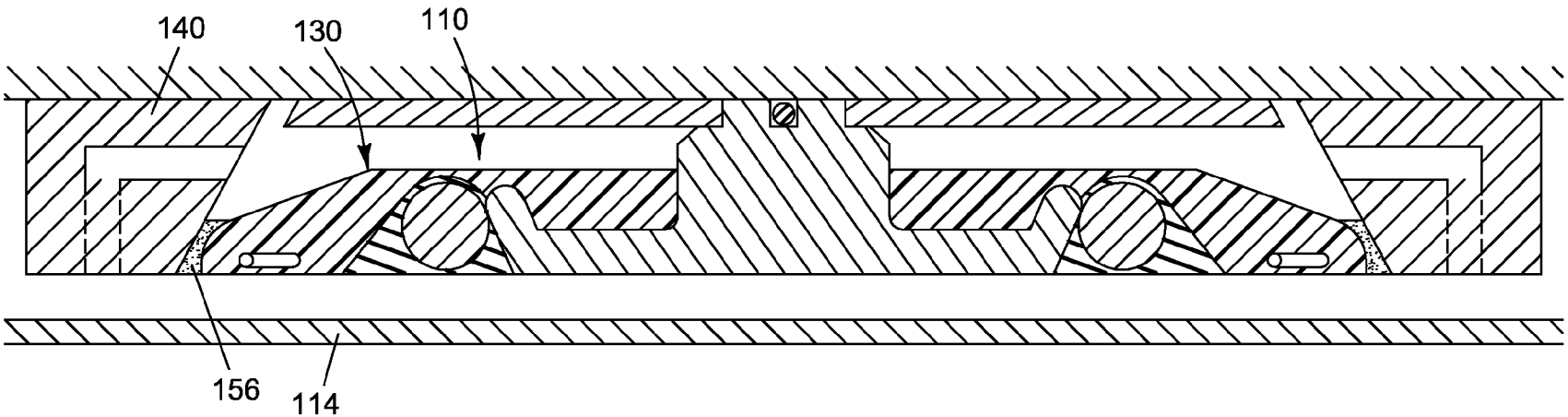
FIG. 3 shows a cross-sectional view of a packing tool in accordance with an alternative embodiment of the present invention in a non-actuated state.

Reference is now made to FIGS. 3 and 4 of the drawings which illustrate a cross-sectional view of a packing tool in accordance with a second embodiment of the present invention in a non-actuated state and an actuated state respectively. Features which correspond with features of the first described embodiment are labelled with the same reference numeral, incremented by 100.

In this tool 110 the end of the elastomeric portion 130 is bonded to the opposing face of the ring member 140 by adhesive 156. Thus, on setting the tool 110, the portion 130*a* tends to buckle outwards into contact with the casing 114, rather than sliding over the face of the ring member.

Figure 6:
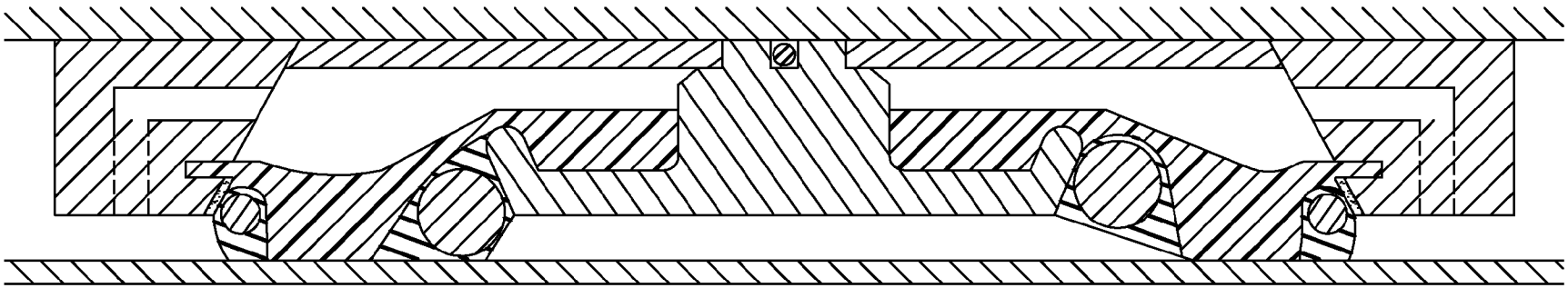
FIG. 6 shows the packing tool of FIG. 5 in an actuated state.
Figure 5:
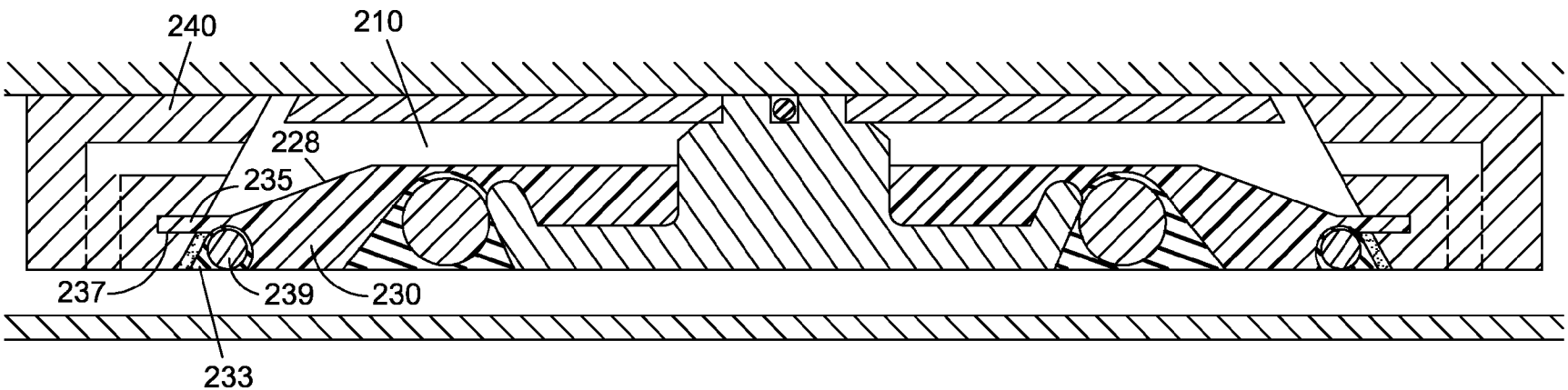
FIG. 5 shows a cross-sectional view of a packing tool in accordance with a third embodiment of the present invention in a non-actuated state.

Reference is now made to FIGS. 5 and 6 which show cross-sectional views of a packing tool in accordance with a third embodiment of the present invention in a non-actuated state and in an actuated state respectively. Features which correspond with the features of the first described embodiment are labelled by the same reference numeral, incremented by 200.

In this tool 210 the lower end of the sealing element 228 is also fixed relative to the adjacent ring member 240, and comprises an additional anti-extrusion portion 233 including a helical spring 239. Also, the end of the elastomeric portion 230 features a tongue 235 which extends into a corresponding slot 237 in the ring member 240.

Figure 7:
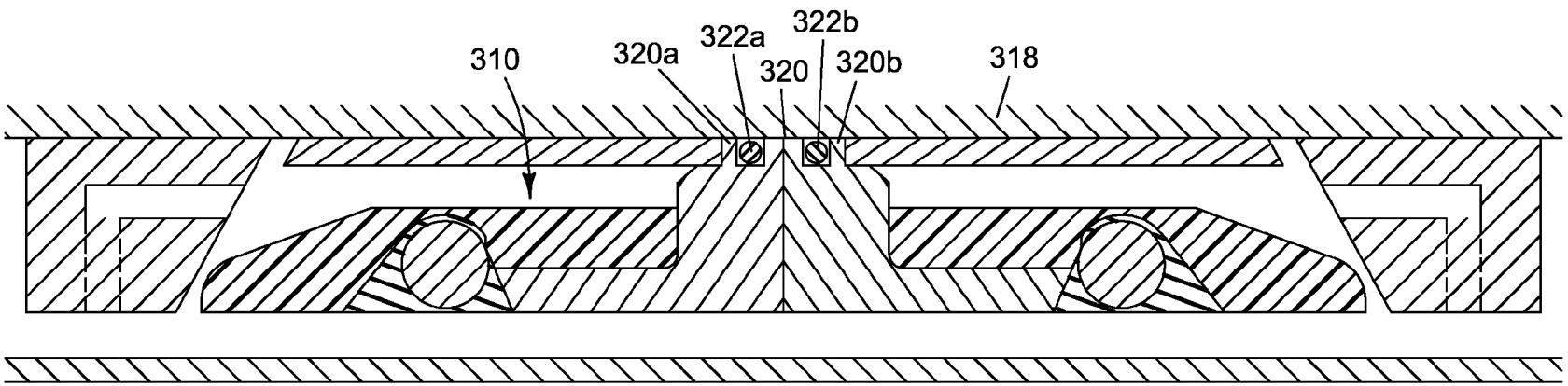
FIG. 7 shows a cross-sectional view of a packing tool in accordance with a fourth embodiment of the present invention in a non-actuated state.

Referring to FIG. 7 which shows a cross-sectional view of a packer tool in accordance with a fourth embodiment of the present invention. Features which correspond with features of the first described embodiment are labelled with the same reference numeral incremented by 300.

In this tool 310, the gauge ring 320 is split into an upper gauge ring 320*a* and a lower gauge ring 320*b* the upper and lower gauge rings 320*a*, 320*b* each having a respective sealing O-ring 322*a*, 322*b* to seal the interface between the gauge ring 320 and the mandrel 318. In this embodiment the first and second radially inwardly extending lips 52, 54 of FIG. 1 have been removed, as has the embedded band spring 36.

Figure 8:
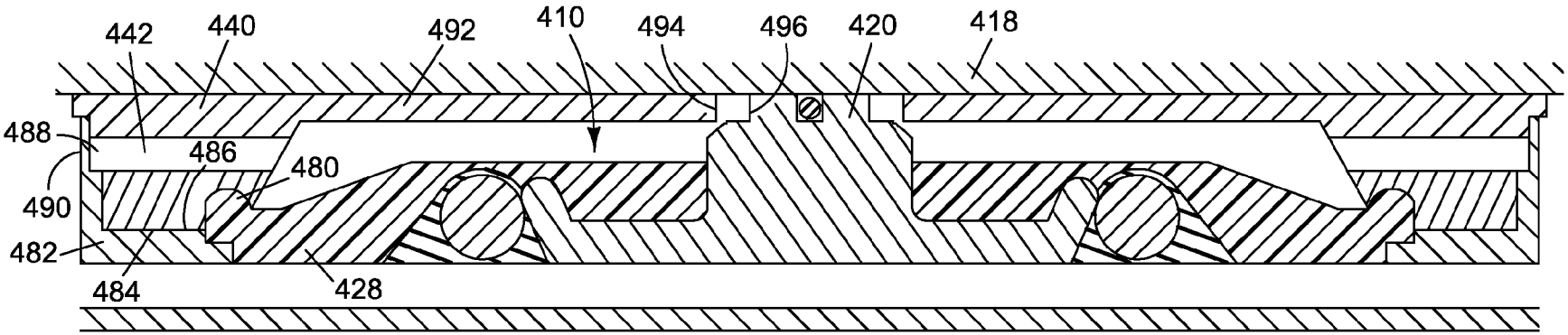
FIG. 8 shows a cross-sectional view of a packing tool in accordance with a fifth embodiment of the present invention in a non-actuated state.

Finally referring to FIG. 8 which shows a cross-sectional view of a packing tool in accordance with a fifth embodiment of the present invention. Features which correspond with features of the first described embodiment are labelled with the same reference numeral incremented by 400.

In this tool 410, the sealing element 428 is mounted into a recess 480 in the ring member 440. The sealing member 428 is secured in this recess by a threaded securing element 482 having a threaded surface 484 which co-operates with a complementary threaded surface 486 on a ring member 440. In this embodiment the communication bore 442 is an axial bore, and the entrance 488 to the communication bore 442 is covered by a sandscreen 490 incorporated into the threaded securing element 482.

In this embodiment the cylindrical can 26 is replaced by an axially extending portion 492 of the ring member 440 which extends adjacent to the mandrel 418. Excess movement of the ring member 440 when actuating the tool is prevented by the end surface 494 of the ring member 440 coming into contact with surface 496 of the gauge ring 420.

Thus, it can be seen that the present invention provides a packing tool which uses a combination of mechanical and hydraulic pressure for engaging the bore wall, and which uses a relatively robust mechanism. It will be understood that the embodiments herein described are for illustration only, and that variations and modifications may be made to the described constructions without departing from the scope of the invention.

We claim:

1. A packing tool comprising:

a sealing element for mounting on a mandrel so as to define a volume between the sealing element and the mandrel;

a ring member for mounting on the mandrel adjacent the sealing element, the ring member being axially movable relative to the sealing element to cause deformation of the sealing element; and an annular element having an internal surface facing and for mounting on the mandrel, on which annular element the sealing element is mounted;

wherein the ring member includes a communicating bore extending between the volume defined between the sealing element and the mandrel and an exterior portion of the tool; and wherein the sealing element is at least partially mounted to an internal surface of the annular element.

2. A packing tool according to claim 1, wherein the ring member serves to close the volume.

3. A packing tool according to claim 1, wherein the ring member is movable against a radially inner portion of the sealing member.

4. A packing tool according to claim 1, wherein the annular element is rigid.

5. A packing tool according to claim 1, wherein the annular element is formed of metal.

6. A packing tool according to claim 1, wherein the annular element further comprises sealing means for providing a seal between the element and the mandrel.

7. A packing tool according to claim 6, wherein the sealing means comprises an O-ring.

8. A packing tool according to claim 1, wherein the annular element comprises an upper annular element and a lower annular element.

9. A packing tool according to claim 1, wherein the annular element comprises an axially extending portion located radially outward of a portion of the sealing element.

10. A packing tool according to claim 9, wherein the axially extending portion includes a radially inwardly extending lip, the lip extending from at least one marginal region of the axially extending portion.

11. A packing tool according to claim 1, wherein the sealing element is resilient.

12. A packing tool according to claim 11, wherein the resilient sealing element comprises a relatively hard portion.

13. A packing tool according to claim 12, wherein the hard portion is located towards the other end of the sealing element from the ring member.

14. A packing tool according to claim 1, wherein the sealing element is elastomeric.

15. A packing tool according to claim 1, wherein the sealing element comprises an annular spring member embedded within the sealing element.

16. A packing tool according to claim 15, wherein the spring is a garter spring.

17. A packing tool according to claim 15, wherein the spring is a dual spring.

18. A packing tool according to claim 15, wherein the sealing element further comprises a second spring member embedded within the sealing element at the portion adjacent the ring member.

19. A packing tool according to claim 18, wherein the second spring member is a band spring.

20. A packing tool according to claim 1, wherein the sealing element is of tapered form.

21. A packing tool according to claim 20, wherein the element is axially tapered.

22. A packing tool according to claim 21, wherein the element is axially tapered toward the end of the element adjacent the ring member.

23. A packing tool according to claim 1, wherein the radially outer surface of the sealing element is generally flat, while the radially inner surface is generally tapered away from the mandrel.

24. A packing tool according to claim 1, wherein the ring member carries a tapered leading face for engaging with the sealing member.

25. A packing tool according to claim 1, wherein the sealing element is bonded or otherwise fixed to the ring member.

26. A packing tool according to claim 1, wherein the sealing element abuts the ring member.

27. A packing tool according to claim 1, wherein the ring member is adapted for movement by application of an axial force thereto.

28. A packing tool according to claim 1, wherein the communicating bore extends between an outer portion and a inner portion of the ring member.

29. A packing tool according to claim 28, wherein the communicating bore extends between a radially outer portion and a radially inner portion of the ring member.

30. A packing tool according to claim 28, wherein the communicating bore extends axially between the outer portion and the inner portion of the ring member.

31. A packing tool according to claim 1, wherein the communicating bore includes a sand screen.

32. A packing tool according to claim 1, wherein the packing tool further comprises a stop for restricting axial movement of the ring member towards the sealing element.

33. A packing tool according to claim 1, wherein the packing tool comprises two sealing elements and ring members arranged generally symmetrically along the mandrel.

34. A packing tool comprising:

a mandrel;

a sealing element mounted on the mandrel, and defining a volume between the sealing element and the mandrel;

a ring member mounted on the mandrel adjacent the sealing element, the ring member being axially movable relative to the sealing element to cause deformation of the sealing element; and an annular element for mounting on the mandrel, on which annular element the sealing element is mounted;

wherein the ring member includes a communicating bore extending between the volume defined between the sealing element and the mandrel and an exterior portion of the tool;

wherein the sealing element is at least partially mounted to an internal surface of the annular element.

35. A method of sealing a bore, the method comprising the steps of:

locating in a bore a packing tool comprising a mandrel, an annular element having an internal surface facing and mounted on the mandrel, a sealing element mounted on the annular element, and a ring member mounted on the mandrel;

moving the ring member relative to the sealing element to deform the sealing element to contact the bore wall, creating an initial seal; and allowing fluid to flow through a communicating bore in the ring member into a volume between the sealing element and the mandrel to increase pressure in the volume, to further deform the sealing element and maintain the seal;

wherein the sealing element is carried by and at least partially mounted to an internal surface of the annular element.

36. A packing tool comprising:

a sealing element for mounting on a mandrel so as to define a volume between the sealing element and the mandrel;

a ring member for mounting on the mandrel adjacent the sealing element, the ring member being axially movable relative to the sealing element to cause deformation of the sealing element; and an annular element for mounting on the mandrel, on which annular element the sealing element is mounted;

wherein the ring member includes a communicating bore extending between the volume defined between the sealing element and the mandrel and an exterior portion of the tool; and wherein the annular element further comprises sealing means for providing a seal between the element and the mandrel.

37. A packing tool comprising:

a sealing element for mounting on a mandrel so as to define a volume between the sealing element and the mandrel;

a ring member for mounting on the mandrel adjacent the sealing element, the ring member being axially movable relative to the sealing element to cause deformation of the sealing element; and an annular element for mounting on the mandrel, on which annular element the sealing element is mounted;

wherein the ring member includes a communicating bore extending between the volume defined between the sealing element and the mandrel and an exterior portion of the tool;

wherein the annular element comprises an axially extending portion located radially outward of a portion of the sealing element; and wherein the axially extending portion includes a radially inwardly extending lip, the lip extending from at least one marginal region of the axially extending portion.

* * * * *